United States Patent [19]

Rossin et al.

[11] Patent Number: 4,508,308

[45] Date of Patent: Apr. 2, 1985

[54] REINFORCEMENT STRUCTURE FOR REINFORCED-CONCRETE BUILDINGS

[75] Inventors: Ineo Rossin, Minerbe; Francesco Zanella, Verona, both of Italy

[73] Assignee: Edilvelox S.R.L., Verona, Italy

[21] Appl. No.: 374,794

[22] Filed: May 4, 1982

[30] Foreign Application Priority Data

May 7, 1981 [IT] Italy ..... 21571 A/81

[51] Int. Cl.[3] ..... E04G 11/02

[52] U.S. Cl. ..... 249/19; 52/486; 249/23; 249/27; 249/90; 249/192; 249/211; 264/35

[58] Field of Search ..... 264/35; 249/23, 27, 249/211, 189, 192, 194, 19, 90; 52/486

[56] References Cited

U.S. PATENT DOCUMENTS

| | | | |
|---|---|---|---|
| 951,120 | 3/1910 | Hockett | 249/189 X |
| 1,279,472 | 9/1918 | Springer | 264/35 X |
| 1,293,036 | 2/1919 | Church | 249/189 X |
| 1,368,131 | 2/1921 | Fluor | 264/35 X |
| 1,374,864 | 4/1921 | Rashkovsky | 249/189 X |
| 1,702,659 | 2/1929 | Miles | 249/27 X |
| 1,771,119 | 7/1930 | Hayden | 249/23 |
| 1,936,531 | 11/1933 | Weber | 249/23 |
| 1,949,083 | 2/1934 | Roberg | 249/23 |
| 2,037,965 | 4/1936 | Colt | 249/211 |
| 2,050,858 | 8/1936 | Pinaud et al. | 249/211 |
| 2,455,455 | 12/1948 | West | 249/189 |
| 3,899,155 | 8/1975 | Ward | 249/189 |

FOREIGN PATENT DOCUMENTS

| | | | |
|---|---|---|---|
| 512343 | 2/1957 | Italy | 264/35 |
| 512342 | 2/1957 | Italy | 52/633 |

*Primary Examiner*—Jay H. Woo
*Assistant Examiner*—James C. Housel
*Attorney, Agent, or Firm*—Charles E. Brown; Charles A. Brown

[57] ABSTRACT

A reinforcement structure for reinforced-concrete buildings, comprises a servicing portion which can be dismantled and a fixed structural portion which shall remain embedded in the concrete casting and consists of an iron latticework which is also intended to support the servicing portion. The servicing portion comprises spacer elements and sidewall elements having stiffening reinforcements and members and elements are provided to releasably latching the spacer elements and the sidewall elements to the latticework framing. Such a reinforcement structure also makes possible a novel building method.

12 Claims, 9 Drawing Figures

REINFORCEMENT STRUCTURE FOR REINFORCED-CONCRETE BUILDINGS

This invention relates to a reinforcing structure for buildings made of reinforced-concrete, such as concrete based on Portland cement having an iron reinforcement, particular for civil buildings, and is also concerned with a building procedure which exploits such a reinforcing structure.

The term "reinforcing structure" is used herein in the twofold meaning of servicing portion and of a metallic skeleton having supporting functions for the structure which is obtained upon concrete casting.

The servicing portion, that is, the temporary supporting structure for the building to be erected, is composed, as is well known, of the moulds (also called forms or boxings) and of the so-called cribbing which is used to support the moulds and all the loads insisting thereon until the structure becomes self-supporting.

The iron skeleton, instead, is intended to remain embedded within the mass of cement-based or non-cement based concrete to impart to the building the expected resistance properties.

Buildings of reinforced concrete, such as those constructed in the building industry, with the exception of prefabricated work, are usually made according to the conventional run, by installing on the spot the moulds and the attendant cribbing, the latter having the necessary bracings, positioning in the moulds the iron rod reinforcements, usually according to a cage-like pattern, casting the concrete mix, usually in a number of discrete steps, and eventually providing to the removal of the falsework as soon as the structure has become self-supporting, that is, as it has ripened enough. If buildings having a certain size are involved, and/or buildings having many tiers, these operations are carried out repetitively.

All this work not only requires a great deal of time, but also trained craftmanship and repeated controls to prevent errors during erection.

It is thus an objective of the present invention to provide a reinforcement structure for buildings of reinforced concrete, said reinforcing structure being both intended as a combination supporting structure during the step of mix casting and iron skeleton for the final building, said reinforcing structure being not only easier to install and to dismantle and permitting to obtain buildings having an improved outer finishing after the dismantling of the falsework, but being such as to introduce a complete change in the conventional erection procedure briefly outlined hereinbefore, by making thus possible a consistent increase in the speed of processing while concurrently reducing the labour costs.

In order that such an objective may be attained, according to the invention, a composite reinforcing structure is provided, consisting of a servicing portion and a structural portion proper, said structure essentially comprising an assembly of skeleton elements of iron in latticework arrangement having their relevant interconnection members, spacer elements and sidewall elements which can be latched to said skeleton elements, and removable elements and members for latching the sidewall elements and the spacer elements to said skeleton elements.

The structural portion of the reinforcement structure, to wit the one which is intended to remain embedded in the concrete casting is essentially composed of the iron latticework skeleton members to be mutually interconnected, said members being also intended to support the servicing portion: the latter portion may comprise said spacer elements, said sidewall elements and said latching elements and members. It cannot be excluded, however, that also the spacer elements and the sidewall elements may remain, totally or only partially, embedded in the casting.

By adopting a reinforcement structure according to the invention, it becomes possible to reduce to practice a novel method of construction for reinforced concrete buildings which comprises the steps of mounting, at the outset, the iron latticework skeleton while properly interconnecting the individual component parts thereof, fastening them to said iron latticework frame the spacer elements and the sidewall elements, then proceeding with casting the concrete mix into the space thus provided between the sidewall members whereby the iron latticework frame becomes embedded within the casing, and, once that the concrete mix has set, removing the falsework or servicing portion of the reinforcing structure in question.

It is apparent that the erection method according to the invention somewhat inverts the sequence of operations which were carried out after the conventional procedures.

As a matter of fact, the method according to this invention starts from the installation of the latticework members to compose a skeleton which is adapted to sustain the servicing portion.

Stated otherwise, the basic idea of the invention is not to use the servicing portion to support the iron rod skeleton for the mix to be reinforced within the boxings, but, conversely, to use said skeletal structure in the form of an iron latticework as a supporting structure for the servicing portion or falsework.

This reversal of the basic ideas is such as to afford a number of advantages both from the point of view of simplification and acceleration of the building procedure accompanied by a reduction of the occasional causes of error, and of the use of workmanship which, now, need not to be specially trained. In addition, a number of further advantages can be achieved, and it is worth noting to mention an improved finishing of the outer surface of the buildings, as compared with that which was obtained with the conventional boxings, so that, especially in the case of "council buildings" or like cheap constructions, the finishing operations can be reduced somewhat.

The invention will be more detailedly described and illustrated with reference to the accompanying drawings, which show, by way of example only, a few embodiments of the novel reinforcement structure and the manner in which it can be used.

Figure 1:
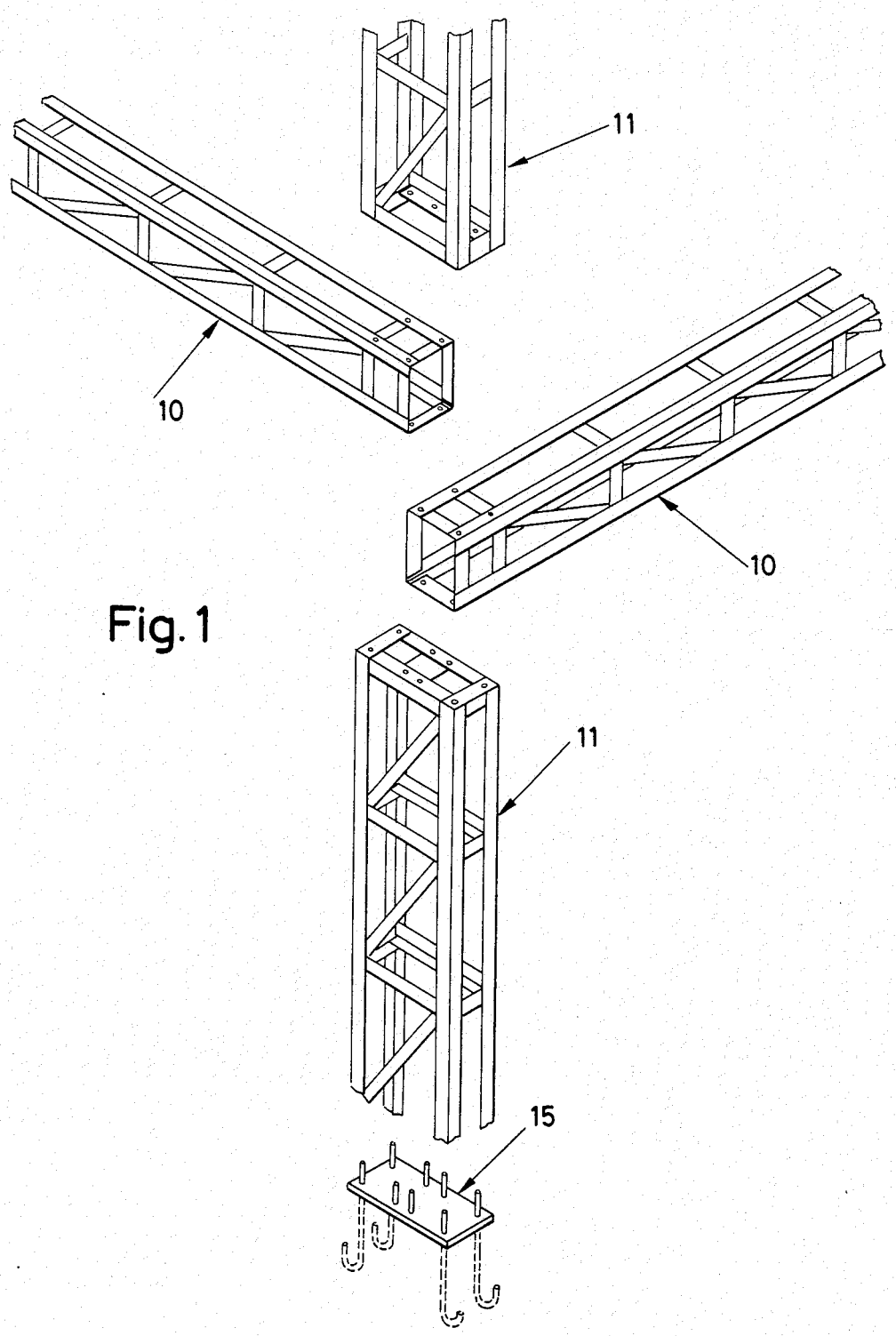
FIG. 1 is an exploded axonometrical view of several component parts of the latticework framing.

As can be seen in FIG. 1, the reinforcement structure comprises, in the first place, lattice-like iron framing members, such as the horizontal component parts indicated at 10 and the vertical component parts indicated at 11. These members, 10 and 11, can be connected to each other and secured in correspondence with their ends, by employing common means, not shown, such as screws, bolts and the like, or they can also be welded together so as to make up a latticework framing, generally indicated at 12 in FIG. 2.

Figure 2:
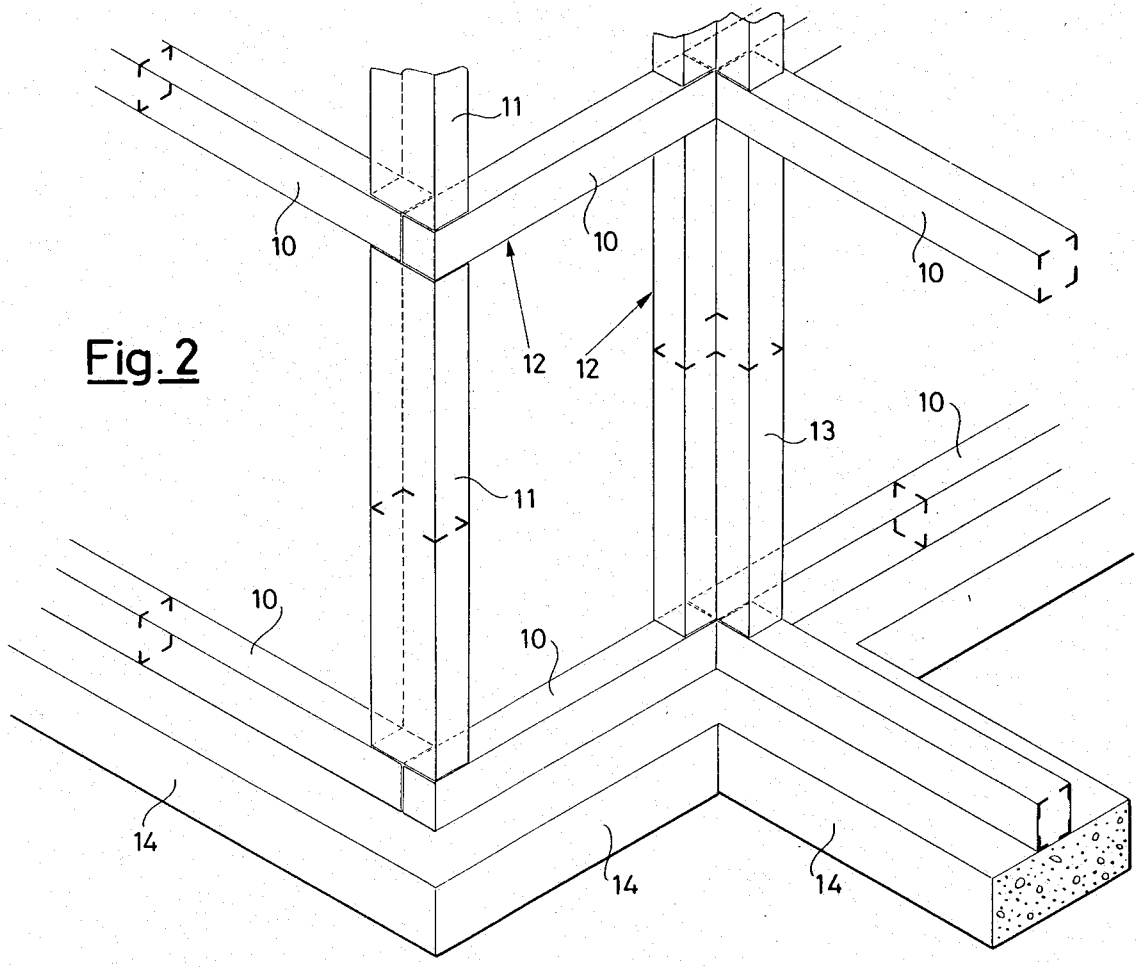
FIG. 2 is a diagram of a portion of latticework which has been mounted in position.

The latticework frames, have, quite advisably, a square or a rectangular cross-sectional contour, but they can have also other sectional contours, if necessary or desired, particularly in correspondence with areas in which two walls meet, such as for example that shown at 13 in FIG. 2, which has an angular cross-section.

The latticework elements 10,11,13 are preferably made with steel angle bars having connection straps 20 and the distance between said angle irons must be such as to permit that the casting may satisfactorily fill the interstices. The size of the latticework is a function of the width of the walls, the number of floors, and other factors. Advantageously enough, the latticeworks are prepared out of the building yard, in a specialized workshop so that, in the building yard it suffices merely to position and to connect them together.

Figure 3:
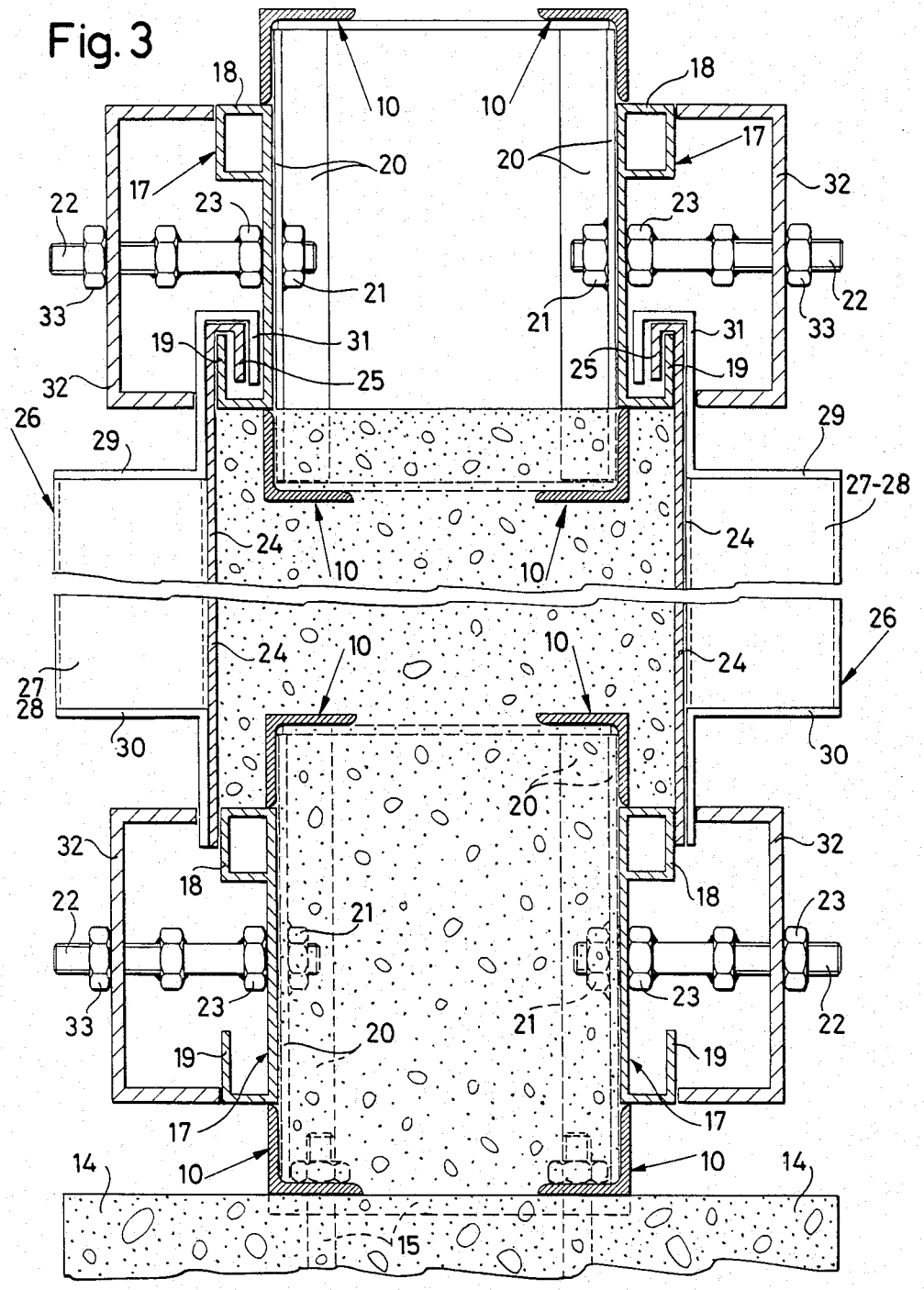
FIG. 3 shows in vertical cross-sectional view the top and the bottom section of the reinforcement structure for a wall.

To start the erection of the latticework 12 beginning from a properly prepared foundation, indicated at 14 in FIGS. 2 and 3, anchoring plates and tiebars such as 15 can be used, secured to said foundation.

Such anchoring plates 15 are embedded in the cast foundations 14 and to such plates the starting horizontal lattice elements 10 are to be secured.

Thereafter, the framing 12 is mounted by arranging the several vertical elements 11, 13 and horizontal elements 10 which provide the top surface whereon the first floor is to be laid.

At this stage, a latticework skeleton is obtained, which is adapted to provide a supporting structure for the servicing portion of the reinforcement structure in question: such skeletal structure is diagrammatically shown in FIG. 2.

To apply the servicing portion to the latticework frame 12, one starts, in the example shown herein, by securing to the horizontal latticework components 10 specially provided spacer elements 17 consisting of flat irons which exhibit, on the one side and in correspondence with either end, a spacing projecting section 18 (for example one having a square cross-section) and, in correspondence with the other end, a hooked protrusion 19, as can be clearly seen in FIG. 3. It should be noted that the outer surface of the projection 18 and that of the hooked extension 19 lie on the same plane which is parallel to the plane of member 17. The height of the spacer element 17 is such as to permit that it may be mounted flush between two parallel horizontal angle irons of the horizontal latticework elements 10. To secure the spacer elements 17 to the horizontal latticework elements 10, the rods 20 are provided, which are a part of the elements 10 to which nuts 21 are welded in correspondence with specially provided through-holes. Also the spacer elements 17 have corresponding through-bores so as to allow either one of any of the screws 22 to be screwed into the nuts 21 and into lock nuts 23 so as to latch the elements 17 to the tie bars 20 of the horizontal latticework elements 10.

Once that the spacer elements 17 have thus been positioned, provision can now be made to hand thereto the component parts proper of the boxings. These elements are the sidewall elements 24 which can be either metallic or also wooden panels, preferably, however, aluminium panels the tops of which are bent at 25 in the fashion of a hook. Such sidewall elements 24 are hung by their hooked extensions 25 to the hooks 19 of the spacer elements 17 secured to the horizontal top elements 10 of the latticework whereas their bottom ends rests against the projecting portion 18 of the spacer elements 17 which are secured to the bottom horizontal latticework elements 10 (best seen in FIG. 3).

In order to provide an appropriate stiffening action on the sidewall elements 24, special vertical stiffening members 26 are provided, consisting of two rectangular steel tubes 27, 28, which are united together at their ends by angle irons 29, 30.

The top angle iron 29 is bent like a hook at 31 so as to enable also these stiffening elements 26 to be hung to the hooks 19 of the spacer elements 17 secured, in their turn, to the top horizontal latticework elements 10. The vertically arranged web of the bottom angle irons 30 of the stiffening members 26 rests against the bottom ends of the sidewall elements 24 and thus also against the projecting portion 18 of the spacer elements 17 which are secured to the bottom horizontal latticework elements 10.

While in the embodiment shown the sidewall elements 24 and the stiffening elements 26 consist of discrete members, it is quite possible, of course, to provide shaped sidewall elements which already possess the required stiffness.

In order to latch the sidewall elements 24 and the stiffening elements 26 in the proper way to the latticework members 10, U-shaped or C-shaped irons 32 are provided, to be laid horizontally, and which have evenly spaced bores formed therethrough for threading screws 22 therein, whereas nuts 33 screwed from the outside to the screws 22 latch the entire assembly to the bottom latticework elements 10 and also to the top elements 10, as can clearly be seen in FIG. 3.

It is apparent that the entire servicing portion, consisting, in the example shown herein, of the spacer elements 17, the sidewall elements 24, the stiffening members 26 and the latching irons 32 with their respective setting members 22, 23, 33, is borne by the latticework framing 12 and, exactly, by the horizontal latticework elements 10 thereof.

The spacer members 17 fulfil the twofold task of sustaining the sidewall elements 24 and the stiffening members 26 in the stage of installation of the servicing portion, and of spacing the external surfaces of the casting from the surfaces of the steel skeleton to be embedded in said casting.

Figure 4:
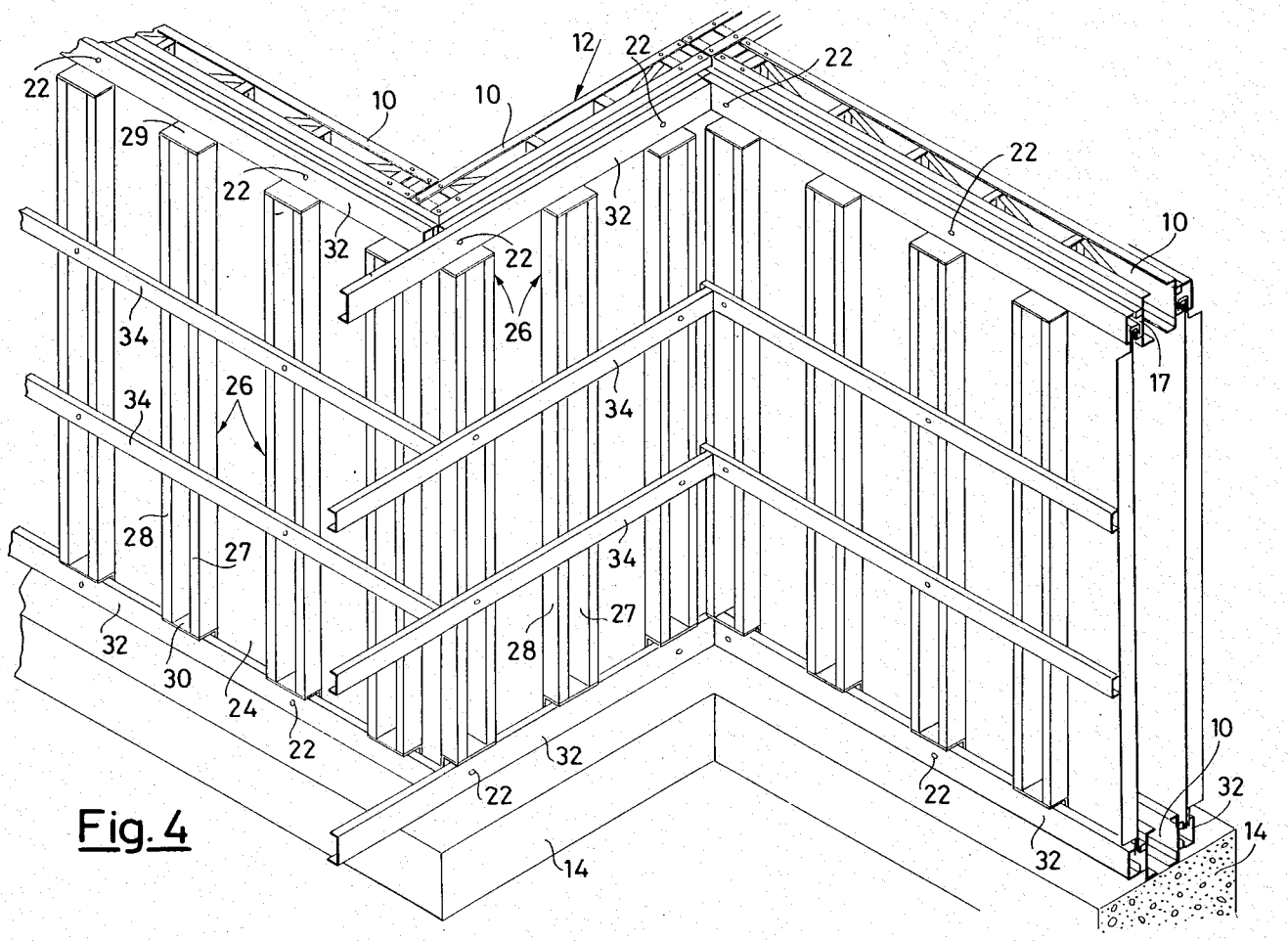
FIG. 4 is an axonometrical view of the reinforcement structure in its position.

On completion of the assemblage as described hereinbefore a complete reinforcement structure is obtained, which comprises the servicing (falsework) structure and the iron reinforcing skeleton for the concrete mix to be reinforced, in readiness for carrying out the casting step (best seen in FIG. 4).

It should be observed that no bracings are required, of any kind, whereas it may be fitting to provide horizontal intermediate stiffening members such as those indicated at 34 in FIG. 4, which can well be of the same kind as that of the irons 32. Such intermediate irons 34 can be connected together pairwise by through-bolts which can be withdrawn as the casting has set.

Now, the casting can be proceeded with, for example with usual concrete or cellular concrete, preferably involving the entire wall height and, if so desired, with the aid of vibrators. The mix is cast until it covers the bottom angles of the top horizontal latticework elements 10 (best seen in FIG. 3).

The casting may involve only the peripheral walls or, if so desired, it may be extended also to the partition walls.

Subsequently, the positioning and the casting of the first floor can be undertaken.

Figure 5:
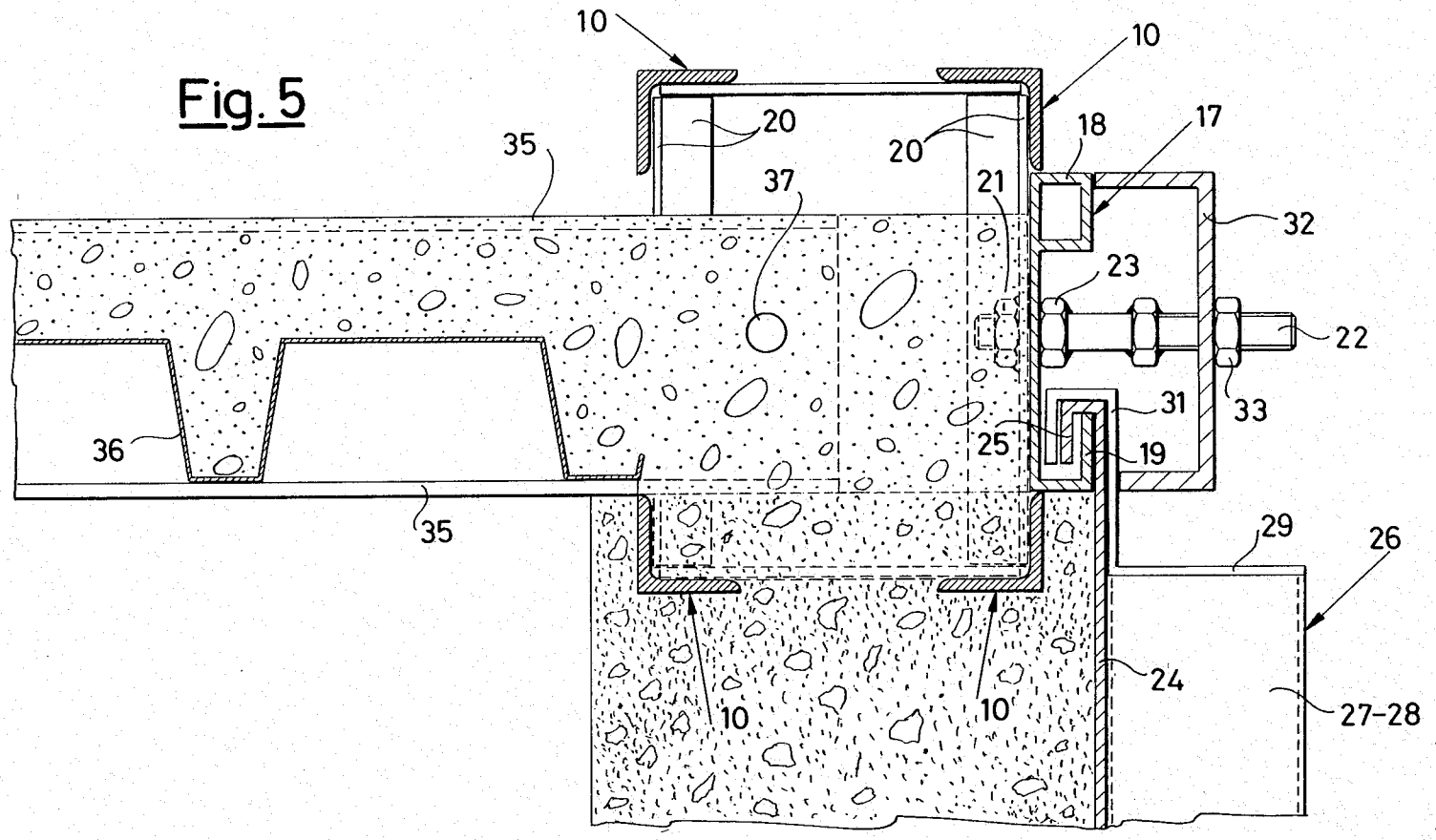
FIG. 5 shows the casting step for a floor, in vertical cross-sectional view.
Figure 6:
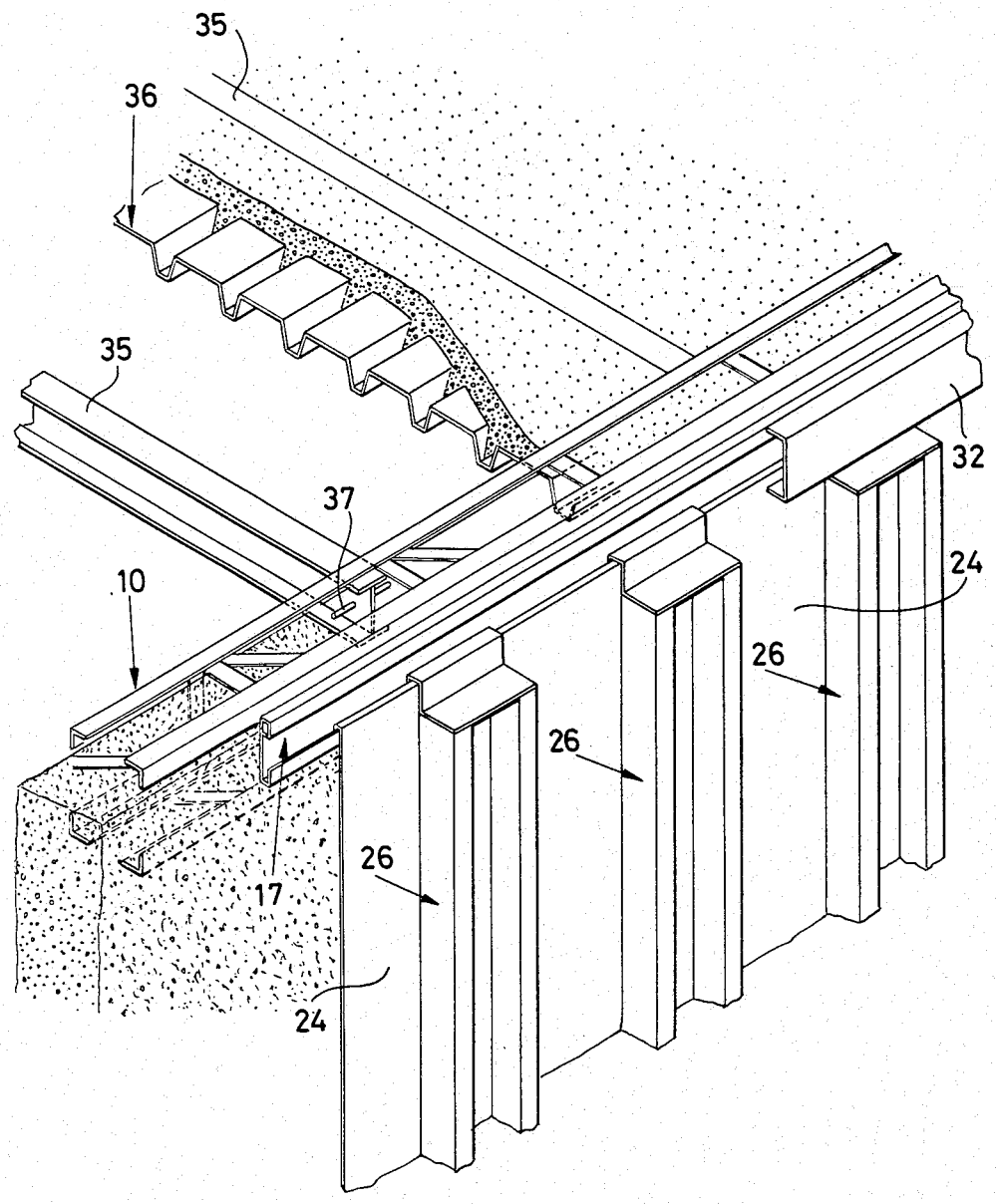
FIG. 6 shows the same casting step for a floor in axonometrical view.

In an advantageous embodiment, the floor can be composed of I-irons, 35, with fretlike corrugated sheet irons 36 inserted therebetween 36 (see FIGS. 5 and 6), while using the top horizontal latticework elements 10 of the structure 12 as a resting surface for the ends of the load-bearing beams 35 of the floor concerned. Dowels 37 inserted into the ends of the load-bearing beams 35 act as stops for such beams. The floor casting can be carried out without any necessity of providing for supporting scaffoldings or intermediate shores.

The floor can be cast with conventional concrete mixes until the casting top surface is flush with the top webs of the I-irons 35 (FIG. 5), that which facilitates smoothing of the surface of the casting.

To carry out dismantling, it suffices to remove the nuts 33 and to withdraw the latching sections 32 and the intermediate stiffening members 34. Thereafter, the stiffening members 26 and the sidewall elements 24 can be withdrawn. Lastly, the spacers 17 are removed and the screws 22 are loosened. It is sufficient, now, to fill, for example with Portland cement mortar the void spaces which are left on the outer walls of the spacer elements 17 and to stop the few holes left by the bolts used for securing the intermediate members 34 to have smooth walls having no appreciable faults, which could even be left exposed without requiring any plastering.

Once that the floor has been cast, it is possible to resume the assemblage for the next floor. The vertical latticework elements 11 and 13 and the horizontal top ones 10 are now installed once more and to the elements 10 the servicing portion is latched again as hereinbefore described. The only difference relative to the operations which have already been described is the latching of the sidewall elements 24 and the stiffening members 26 to the base of the boxing on the internal surface of the walls. This difference is due to the presence of the underlying floor casting.

Figure 7:
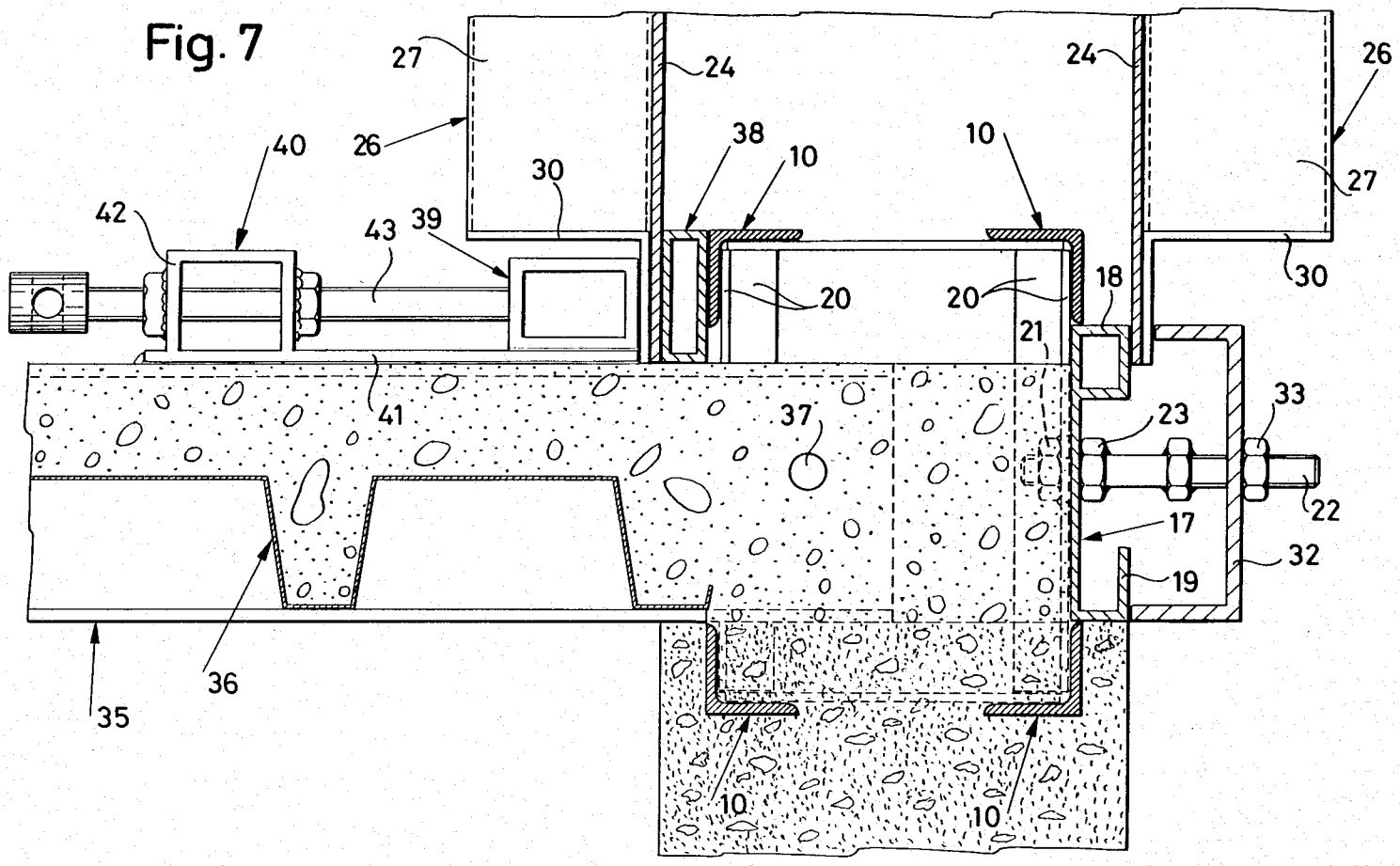
FIG. 7 shows the stage of reinstallation of the reinforcement structure for a wall of an upper wall, and FIGS. 8 and 9 likewise show, in a view akin to that of FIG. 3, alternative embodiments of the reinforcement structure.

As can be seen in FIG. 7, due to the presence of the floor in the interior of the walls, it is not possible to apply, in this area, the usual spacer elements 17 with their attendant latching members. For this reason, a spacing straightedge 38 is used, to be inserted between the top angle iron of the horizontal latticework element 10 and the bottom ends of the sidewall elements 24 and of the stiffening members 26, whereas, to latch said ends, a section 39 is adopted, which, by means of specially provided tools 40, is pushed against such bottom ends to clamp them against the spacing straightedge 38 and thus against the horizontal latticework elements 10. Each tool 40 comprises a base 41 which can be temporarily secured to the top web of a load bearing I-iron 35 and which carries a supporting member 42 for a screw 43, which, when manipulated at either end, pushes with its other end against the section 39. Instead of a plurality of tools 40, a single tool could also be used, having a consistent length and carrying a plurality of screws 43.

Obviously, after casting the walls of the overlying floor, also the tools 40, the sections 39 and the straightedge 38 are withdrawn, also these means thus belong to the servicing portion. The space which has been left free by the straightedge 38 can be filled for example with Portland cement mortar, or by the thickness of the floor.

The reinforcement structure as described hereinbefore with reference to FIGS. 1 to 7 inclusive can be variously modified especially as far as the servicing portion is concerned.

While the servicing portion of the reinforcement structure now described, which is composed of extremely light components capable of being, in their great majority, mounted and dismantled manually, is suitable more particular for comparatively small building yards, that is, for the building of individual houses or houses which are not very tall, it is possible to provide, for larger building yards, heavier boxings which can be such as to comprise entire walls and be hoisted by cranes.

Figure 8:
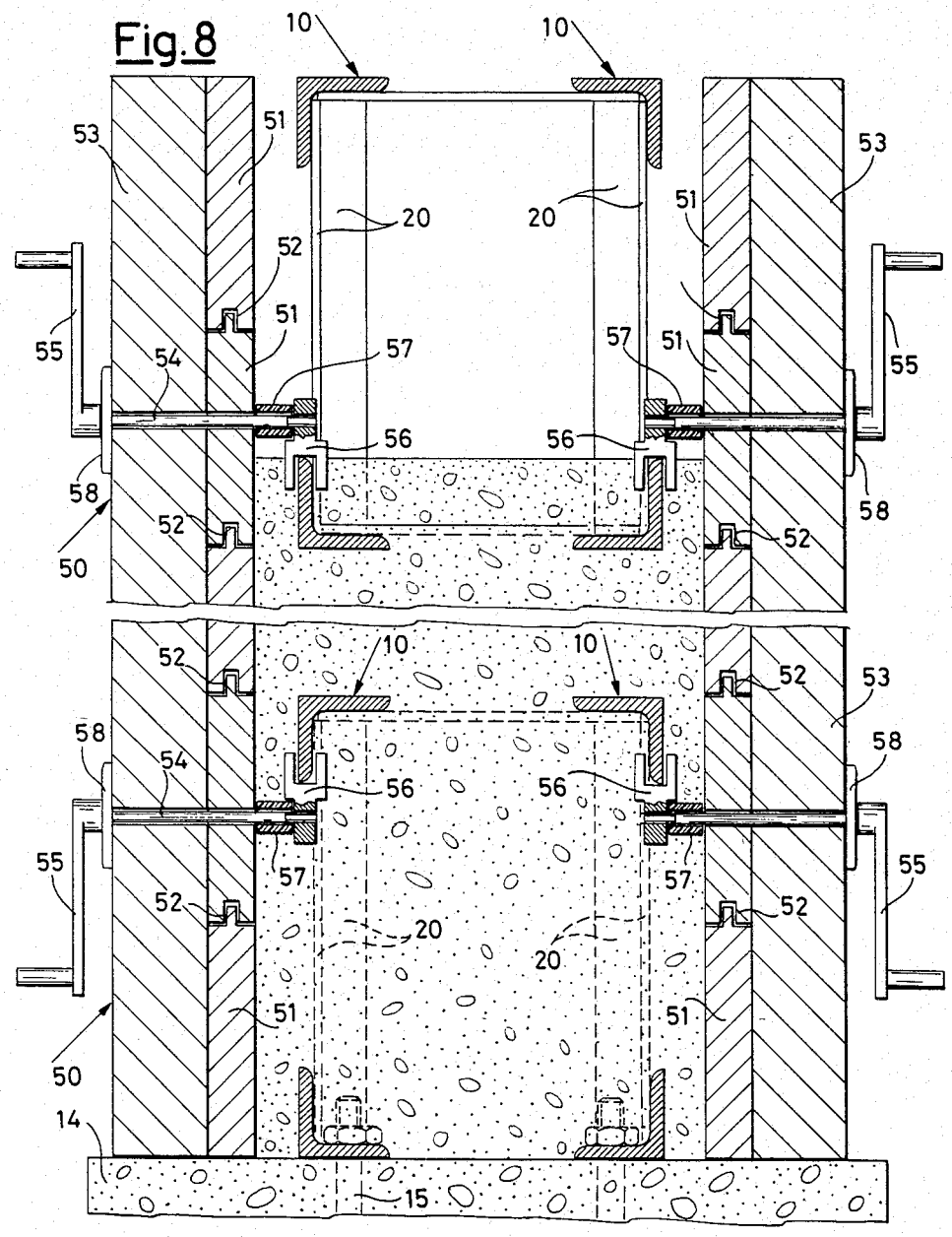

FIG. 8 shows an example in which boxings are provided, generally indicated at 50, which have a wider surface and which have been stiffened beforehand. Such elements 50 are composed, each, of horizontal beams 51 which are held together by mortise and tenon joints such as at 52 and by vertical stiffeners 53. The beams 51 and the elements 53 can be either wooden or metallic and it is also possible to use wooden posts which have been reinforced by vertical metal pieces. Wooden panels could also be adopted instead of the beams.

To latch the boxings 50 to the latticework elements 10 of the framing, special anchoring tools are provided, which are mounted on the moulds. Each of said tools comprise a shaft 54 which is freely rotatably mounted in the element 50 and carries on its external portion a crank 55, which is possibly removable, whereas its screw-threaded inner end is screwably affixed to a nut 56 having a bifurcated extension capable of straddling a web of the angle iron of the latticework element 10. Between the nut 56 and the element 50 a spacer bush 57 is inserted by slipping it onto the shaft 54; spacer 57 may be made of a plastics material and a washer 58 is inserted between the crank 55 and the element 50.

The base portions of the boxings 50 are laid, for example, on the foundation block 14, or, for the upper storeys, on the floor and on a beam belonging to the boxings of the underlying floor, whereafter these elements 50 are anchored, properly spaced by the bushes 57, to the latticework elements 10 by means of said anchoring tools.

The concrete mix can now be cast and, after that it has hardened, the nut 56 with its forked extension and the spacing bush 57 of each anchoring tool remains embedded in the casting, whereas the other component parts of the anchoring tool are recovered together with the boxing elements 50.

If necessary, it is possible to insert between the top and bottom horizontal latticework elements 10, additional angle irons in horizontal parallel couples united together, to which other anchoring tools can be connected so as to improve the stability of the boxings during casting.

Figure 9:
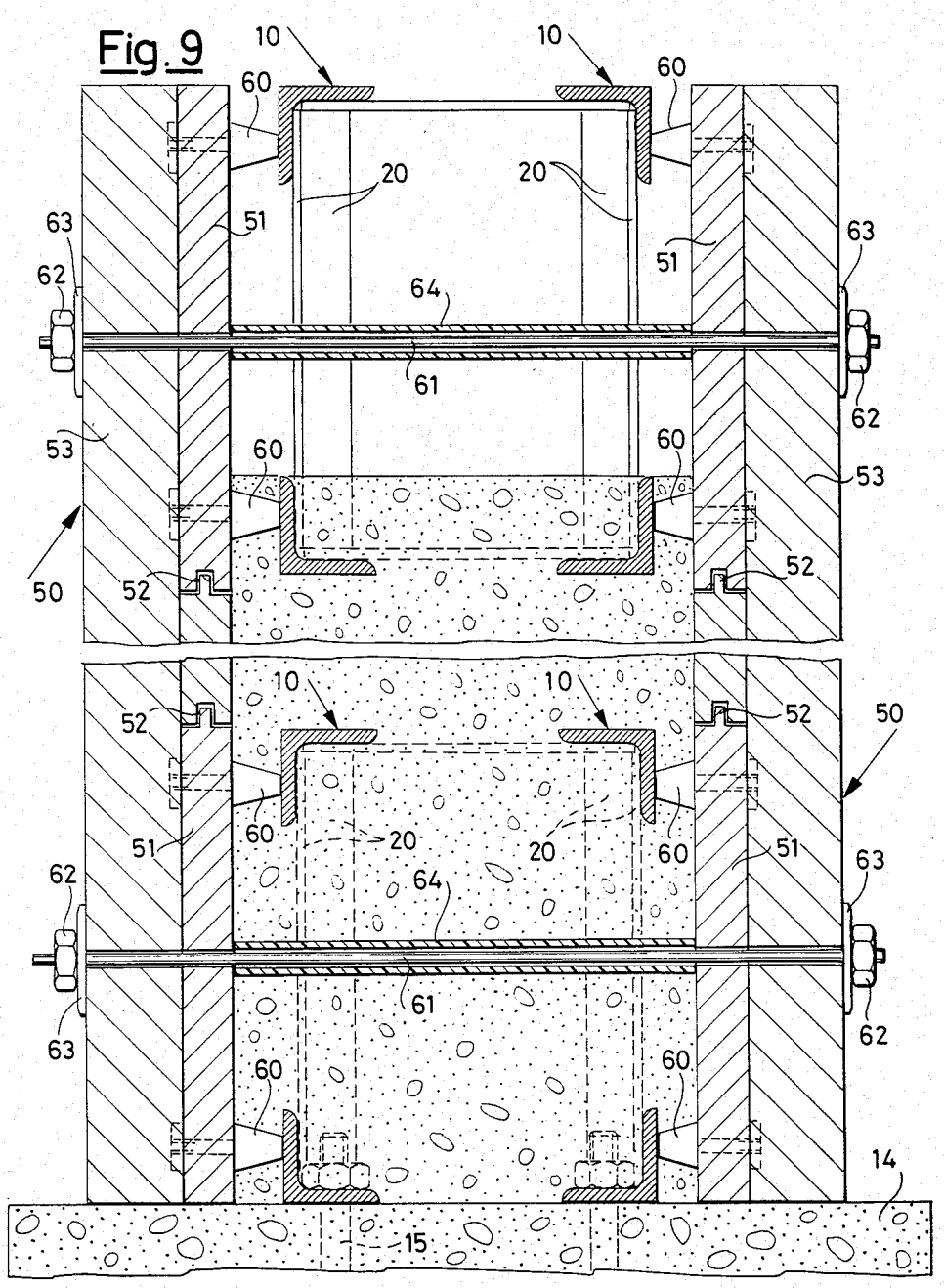

The modification shown in FIG. 9 is much similar to that shown in FIG. 8. Also in this case there are mould elements 50 which are composed of horizontal beams or panels 51 and vertical stiffeners 53. The posts 51 have, secured thereto, spacers 60 having a tapered form and which jut internally out of the posts and are intended to rest against the vertical webs of the angle irons which make up the horizontal latticework elements 10, as can be clearly seen in FIG. 9.

To latch the mould elements 50 with the spacers 60 to the framing 12, and exactly to the horizontal latticework elements 10 thereof, stays 61 are provided with their respective locking nuts 62 and washers 63, said stays being passed through the mould elements 50 which are confrontingly positioned and, between the latter elements, tubes 64 are placed, for example tubes of plastics materials. Such tubes 64 are intended to remain embedded in the casting, whereas it is possible to withdraw, as the casting has set, the stays 61 and the mould elements 50 with the spacers 60 secured thereto. The holes which are left in the casting can be closed, for example, with Portland cement mortar.

It should be noted, also, that it is also possible to employ a mould consisting of sidewall elements which may be left, either totally, or in part, embedded in the casting, and of stiffening members which can be recovered as the casting has set. The sidewall elements or panels which remain attached to the casting may be made of wood, asbestos-cement, plastics materials and other materials.

The servicing portion described in connection with FIGS. 8 and 9 is particularly suitable for large erecting yards in which large boxings are used, also those comprising a full wall.

The reinforcement structure according to the present invention and the building procedure using same afford a number of advantages over the conventional art.

More particularly, a vital advantage is that inherent in the maximum simplification and rapidity in the erection of the buildings, the possibility of errors during erection being reduced to a degree and without any necessity of having trained personnel available. It is sufficient to have at hand operators who are quickly instructed on the spot and no special erecting yard equipment is required.

The method of construction is such as to offer a quite reliable stability since the buildings are reinforced by a latticework frame which is continuous and made of steel, to be embedded in the walls: by so doing, the method of construction is particularly suitable also for areas in which earthquakes are often experienced.

The method of construction is extremely advantageous not only as compared with the conventional erecting methods using load-bearing walls or a reinforced concrete skeleton and brick walls, but is advantageous also as compared with the prefabricated or mixed structures. As compared with the former, in fact, the carpentry work is completely dispensed with, including the positioning of the iron cages, since this work is replaced by the mere assembly of a framing which has been prepared out of the erecting yard and by the assemblage of the servicing portion secured to said framing. The walls which are thus obtained are smooth after casting and do not require, for the normal use in a medium class house of moderate price, to be cement rendered or plaster of Paris plastered.

As compared with prefabricated or mixed buildings the method according to the invention affords the advantage that the prefabrication takes place, so to speak, on the spot, the result being to dispense with shipping and positioning bulky and heavy component parts. Moreover, the method combines many an advantage of prefabrication, such as rapidity of erection and reduced labour costs, with the possibility of constructing, in competition with the conventional methods, multy-storey houses in any place, even in remote locations where it is more difficult to find trained workers.

The method according to the invention, conversely, retains the advantage of the conventional procedure of not being bound to any module or standard size, contrary to what occurs in prefabrication.

The adoption of the construction method according to the invention is, then, particularly suitable for the case of casting made with low-density cellular concrete. In addition, the method according to the invention is not restricted to the used of cement-based concrete, since it is possible to employ other concrete mixes which are based on materials other than cement.

The invention has been described and illustrated by way of example only and it is understood that modifications and changes within the purview of anyone skilled in the art are encompassed within the scope of the invention.

We claim:

1. A reinforcement structure for use in forming reinforced cast concrete buildings, said reinforcement structure comprising a servicing portion and a structural portion; said structural portion being in the form of reinforcing frames for cast concrete beams and columns with said frames being interconnectable to form a structural arrangement and being intended to remain in the cast concrete, each of said frames being formed of a plurality of elongated structural members and interconnecting members to form a rigid structural component; and said servicing portion including spacer elements and sidewall elements, and removable members for releasably directly latching said sidewall elements and said spacer elements to at least certain of said frames to form molds directly mounted on said frames for the casting of concrete in association with said frames, said spacer elements are each in the form of planar sections which on one side have at one end a projecting spacer portion and at the other end a projecting hook extension, the height of such planar sections being such as to permit the insertion thereof between two ones of said structural members of one of said frames with outer surfaces of the projecting portion and the hook portion being coplanar in a plane parallel to the plane of said planar section.

2. A reinforcement structure according to claim 1 wherein said sidewall elements are each in the form of panels which have at one edge a hooked extension for being anchored to the hook portion of one of said spacer elements.

3. A reinforcement structure according to claim 2 wherein said spacer elements are secured to horizontal ones of said frames and have their hook portions disposed lowermost, said sidewall elements being hung by their hooked extensions to said hook portions.

4. A reinforcement structure according to claim 3 wherein stiffening members are provided and which are superposed to said sidewall elements and are hooked to said spacer elements, said stiffening members being latched to said horizontal frames together with said sidewall elements.

5. A reinforcement structure according to claim 1 wherein said interconnecting members include wall rods, and there are, for latching said spacer elements and said sidewall elements to said frames, channel members which act from the outside upon said spacer elements and against ends of said sidewall elements and in that they are latched to said wall rods by nuts.

6. A reinforcement structure according to claim 5 wherein said removable members include removable screws which are passed through said spacer elements and said channel members which act from the outside, a free end of each of said screws receiving a locking nut bearing against the channel member.

7. A reinforcement structure for reinforced concrete walls of buildings, comprising a structural portion intended to be left embedded in the casting and consisting of an iron frame skeleton having horizontal and vertical elements rigidly connected to each other and a servicing portion intended to be recovered at least partially when the casting has set and consisting of spacer elements, sidewall elements and removable members for latching said spacer elements and said sidewall elements to said iron frame skeleton, characterized in that said spacer elements are secured to said horizontal elements, vertically superposed, of said iron frame skeleton and consist of planar sections which on one side have at their upper end a projecting spacer portion and at their lower end a hooked extension, the outer surfaces of said projecting portion and of said hooked extension being coplanar on a plane parallel to the plane of said planar section, and said sidewall elements being composed of panels which have a hooked upper extension to be hung on said hooked extension of an upper spacer element and secured thereto, while their lower edge rests against and is secured to said projecting portion of a lower spacer element.

8. A reinforcement structure according to claim 7, characterized in that said horizontal and vertical elements of said iron frame skeleton are composed of angle irons parallel to each other and interconnected by wall rods, and in that said planar section of said spacer element has a height such as to permit insertion of said spacer element between two parallel angle irons of said horizontal elements.

9. A reinforcement structure according to claim 7, characterized in that additional stiffening members are provided to be superposed on said sidewall elements, said stiffening members each have a hooked upper extension to be hung on said hooked extension of the upper spacer element, while a lower edge of said stiffening member rests against bottom end of said sidewall element and thus against projecting portion of the lower spacer element, and said stiffening members are secured together with said sidewall elements respectively to said hooked extension and to said projecting portion of the upper and lower spacer elements.

10. A reinforcement structure according to claim 7, characterized in that said sidewall elements consist of shaped panels properly stiffened.

11. A reinforcement structure according to claim 7, characterized in that there are provided channel irons for latching said spacer elements and said sidewall elements to said horizontal elements of said iron frame skeleton, said channel irons have flanges of different lengths, and as positioned to act upon the said spacer elements and against the ends of said sidewall elements, and said channel irons are latched to said horizontal elements of said iron frame skeleton by removable elements.

12. A reinforcement structure according to claim 11, characterized in that said horizontal elements of said iron frame skeleton have nuts into which screws are removably screwed, and said screws are passed through said spacer element and said channel iron acting from the outside, with the free end of said screws having locking nuts secured thereto.

* * * * *